United States Patent [19]

Nagi et al.

[11] Patent Number: 5,012,890

[45] Date of Patent: May 7, 1991

[54] ACOUSTIC APPARATUS

[75] Inventors: Katsuo Nagi; Kazunari Furukawa, both of Hamamatsu, Japan

[73] Assignee: Yamaha Corporation, Hamamatsu, Japan

[21] Appl. No.: 323,667

[22] Filed: Mar. 15, 1989

[30] Foreign Application Priority Data

Mar. 23, 1988 [JP] Japan ..... 63-67122
Mar. 23, 1988 [JP] Japan ..... 63-67123

[51] Int. Cl.[5] ..... G10K 11/04

[52] U.S. Cl. ..... 181/160; 181/153; 181/156; 181/199; 381/96; 381/159

[58] Field of Search ..... 181/141, 148, 153, 155, 181/156, 160, 199; 381/28, 71, 93, 94, 96–98, 159

[56] References Cited

U.S. PATENT DOCUMENTS 3,821,473 6/1974 Mullins ..... 381/96
4,126,204 11/1978 Ogi et al. ..... 181/156
4,135,600 1/1979 Ogi et al. ..... 181/156
4,180,706 12/1979 Bakgaard ..... 381/96
4,741,040 4/1988 Kaizer ..... 181/96 X

FOREIGN PATENT DOCUMENTS 57-22477 5/1982 Japan .

*Primary Examiner*—Benjamin R. Fuller
*Attorney, Agent, or Firm*—Spenseley, Horn, Jubas & Lubitz

[57] ABSTRACT

In an acoustic apparatus in which a vibrator is arranged in a Helmholtz's resonator having an open duct port, and the vibrator is driven to radiate a resonant acoustic wave, a duct resonance absorbing means is provided to the open duct port constituting the Helmholtz's resonator so as to remove an unnecessary resonant sound other than a Helmholz's resonant sound caused when the Helmholtz's resonator is driven, thereby removing noise in a radiated acoustic wave and improving distortion characteristics.

8 Claims, 6 Drawing Sheets

ACOUSTIC APPARATUS

BACKGROUND OF THE INVENTION

1. Field of the Invention

The present invention relates to an acoustic apparatus in which a vibrator is arranged in a Helmholtz's resonator having an open duct port, and is driven to radiate a resonant acoustic wave and, more particularly, to an acoustic apparatus in which an unnecessary resonant sound other than a Helmholtz's resonant sound produced when the Helmholtz's resonator is driven is eliminated, thereby removing noise in a radiated acoustic wave and improving distortion characteristics.

2. Description of the Prior Art

As an acoustic apparatus solely utilizing a Helmholtz's resonance, a phase-inversion (bass-reflex) speaker system is known. FIGS. 15A and 15B are respectively a perspective view and a sectional view showing an arrangement of the bass-reflex speaker system. In the speaker system shown in FIGS. 15A and 15B, a hole is formed in the front surface of an enclosure 6, a vibrator consisting of a diaphragm 2 and a dynamic speaker 3 is mounted in the hole, and an open duct port 8 having a sound path 7 is formed therebelow. In the bass-reflex speaker system according to the conventional basic design, a resonance frequency $f_{OP}$ defined by an air spring of the enclosure 6 and an air mass in the sound path 7 is set to be lower than a lowest resonance frequency $f_0$ of the vibrator (speaker) when the vibrator is assembled in the bass-reflex enclosure. At a frequency higher than the resonance frequency defined by the air spring and the air mass, the phase of sound pressure from the rear surface of the diaphragm 2 is inverted at the sound path 7. Consequently, in front of the enclosure 6, a sound directly radiated from the front surface of the diaphragm 2 is in phase with a sound from the open duct port, thus increasing the sound pressure. As a result, according to an optimally designed bass-reflex speaker system, the frequency characteristics of the output sound pressure can be expanded to the resonance frequency $f_0$ of the vibrator or less. As indicated by an alternate long and two short dashed curve in FIG. 16, a uniform reproduction range can be widened as compared to an infinite plane baffle or closed baffle.

However, in the bass-reflex speaker system, open duct resonance occurs at the open duct port portion, and the resonant sound is radiated as noise or a distortion component of an acoustic wave.

In order to eliminate such distortion or noise, another acoustic apparatus wherein a small-diameter portion is formed in the central portion of a port to eliminate port resonance has been proposed (Japanese Utility Model Publication No. Sho 54-35068). However, in this case, as the diameter of the small-diameter portion is decreased to enhance a filter effect, an acoustic resistance of the port is increased, and the Q value of the Helmholtz's resonance is decreased. As a result, the behavior of the speaker system approximates an operation in a closed space, and its frequency characteristics approximate those indicated by an alternate long and short dashed curve in FIG. 16. Therefore, bass-sound radiation power is decreased.

SUMMARY OF THE INVENTION

The present invention has been made in consideration of the conventional problems described above, and has as its object to provide an acoustic apparatus using a Helmholtz's resonator having an open duct port, which can prevent an unnecessary open duct resonant sound generated when the Helmholtz's resonator is driven and can eliminate noise or radiated sound distortion while minimizing a decrease in the Q value of the Helmholtz's resonator, and hence, bass-sound radiation power of the acoustic apparatus having the Helmholtz's resonator.

In order to achieve the above object, according to the present invention, a duct resonance absorbing means for suppressing duct resonance is arranged at or near a portion generating a speed node of open duct resonance of the open duct port of the Helmholtz's resonator. As the duct resonance absorbing means, another resonator resonating with the frequency of the open duct resonance and pressure relaxing means can be exemplified.

The other resonator can employ a Helmholtz's resonator tuned to the open duct resonance frequency of the open duct port, a closed duct resonator, or the The pressure relaxing means is arranged as follows (1) The speed node generating portion of the open duct port is formed by an air-permeable material having an acoustic resistance, such as felt, sponge, unwoven fabric, fabric, or the like, or the air-permeable material is adhered to the inner surface of the corresponding portion.

(2) The speed node generating portion of the open duct port is formed by a flexible material having visco-elasticity, such as rubber or the like.

(3) Micro-gaps or micro-openings having an acoustic resistance are formed in the speed node generating portion of the open duct port.

(4) The methods (1) to (3) are combined.

(5) The entire open duct port is formed by a material of the method (1) or (2).

In the present invention with the above-mentioned structure, an unnecessary resonant sound generated independently of Helmholtz's resonance at the open duct port of the Helmholtz's resonator, i.e., an open duct resonant sound determined by a port length is absorbed and canceled by the duct resonance absorbing means.

The resonant sound absorbing or canceling effect is enhanced as the position of the duct resonance absorbing means is moved closer to the speed node position of the open duct resonance.

Since the resonator also serves as an absorber of a resonance frequency sound, the other resonator tuned to the open duct resonance frequency can be preferably used as the duct resonance absorbing means.

Since the speed node is the antinode of a pressure, the pressure wave relaxing means can be arranged at or near a portion generating the speed node of the open duct resonance, so that the open duct resonant sound can also be absorbed or canceled. In this case, pressure caused by the open duct resonance is relaxed by absorption due to the resistance of the inner surface of the pressure relaxing means, leakage due to air permeability, or damping due to flexibility, so that a change in pressure (density of air) at the open duct port of the Helmholtz's resonator can be relaxed. Thus, a pressure amplitude of the open duct resonance can be suppressed. More specifically, the Q value of the open duct resonance can be reduced. Therefore, the open duct resonant sound determined by the port length is reduced in level or extinguished.

The effect of the pressure relaxing means is enhanced as the position of the pressure relaxing means is closer to the speed node position, i.e., the antinode of the pressure of the open duct resonance.

According to the present invention, since the unnecessary resonant sound is absorbed and canceled as described above, radiation of the open duct resonant sound as a noise or distortion component of the acoustic apparatus using the Helmholtz's resonator can be reduced or prevented.

In particular, when the other resonator as the duct resonance absorbing means is tuned to a specific frequency, it can remove only an unnecessary oscillation (unnecessary resonant sound). Therefore, when the unnecessary oscillation frequency is sufficiently separated from the Helmholtz's resonance frequency, the unnecessary oscillation can be removed without adversely influencing Helmholtz's resonance.

According to the present invention since the open duct port need not be extremely narrow, the Helmholtz's resonance is not so influenced from this point of view.

Figure 1:
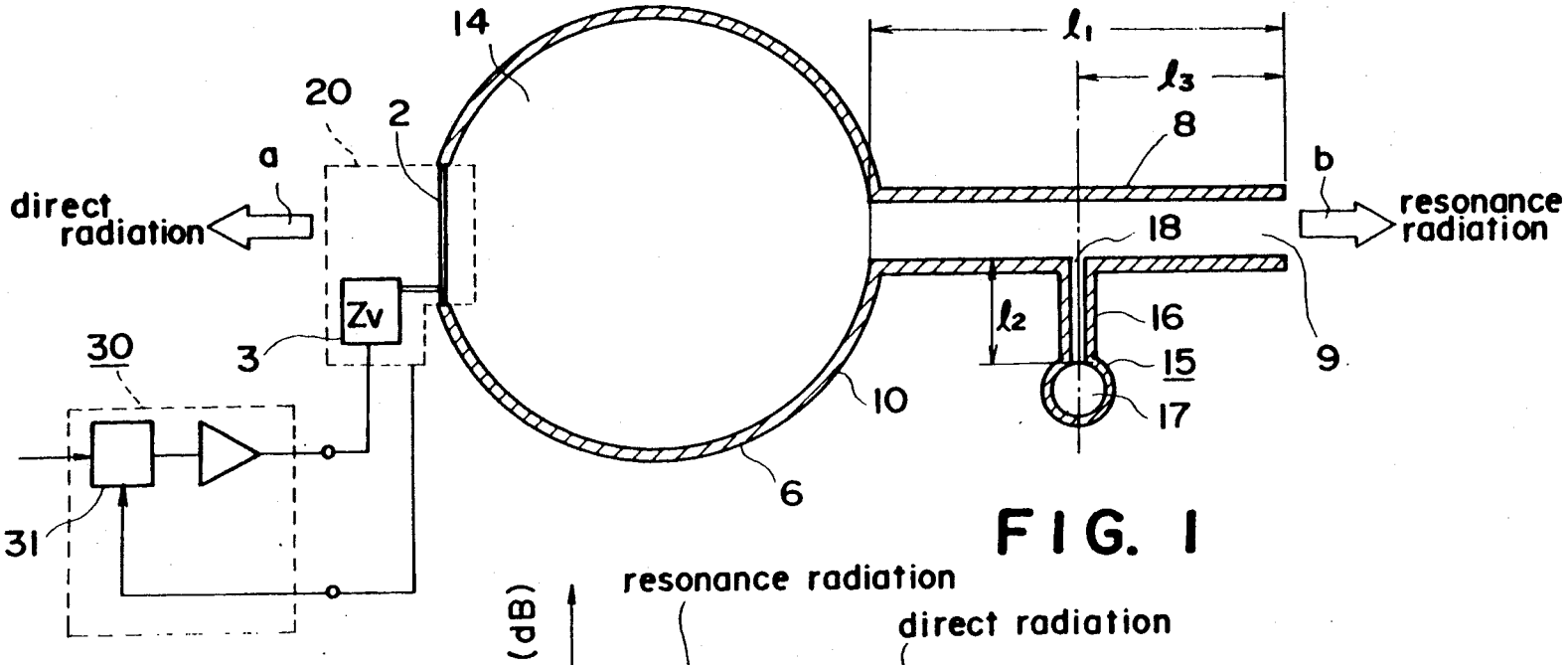
FIG. 1 is a view for explaining the basic structure of a first embodiment of the present invention.
Figure 2:
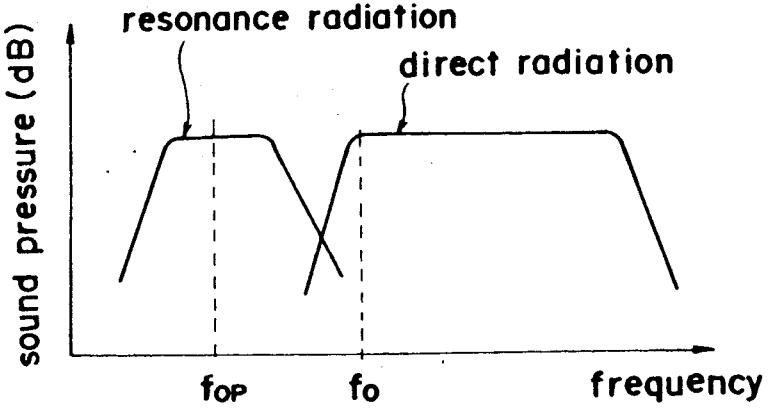
FIG. 2 is a graph showing frequency characteristics of a sound pressure of an acoustic wave radiated from an acoustic apparatus shown in FIG. 1.

DETAILED DESCRIPTION OF THE PREFERRED EMBODIMENTS:

An embodiment of the present invention will now be described with reference to FIGS. 1 to 14. Note that the same reference numerals in the following embodiments of the present invention denote the common or corresponding elements in the prior art.

First Embodiment

FIG. 1 shows the basic structure of an acoustic apparatus according to a first embodiment of the present invention. The acoustic apparatus shown in FIG. 1 employs a Helmholtz's resonator 10 having an open duct port 8 comprised of an open port 9 serving as a resonance radiating portion. In the Helmholtz's resonator 10, an air resonance phenomenon is caused by a closed cavity 14 in a body portion 6 and the open duct port 8. A resonance frequency $f_{OP1}$ is given by:

$$f_{OP1}=c(S_1/l_1V_1)^{\frac{1}{2}}/2\pi \quad (1)$$

where c is the sonic speed, $S_1$ is the sectional area of the open port 9, $l_1$ is the length of the open duct port 8, and $V_1$ is the volume of the cavity 14.

A second Helmholtz's resonator 15 is disposed on the open duct port 8 of the Helmholtz's resonator 10. The second Helmholtz's resonator 15 has an open duct port 16 and a cavity 17, and is open to the central portion of the open duct port 8 through an open port 18 of the open duct port 16.

A resonance frequency $f_{0P2}$ of the second Helmholtz's resonator 15 is given by:

$$f_{0P2}=c(S_2/l_2V_2)^{\frac{1}{2}}/2\pi \quad (2)$$

where c is the sonic speed, $S_2$ is the sectional area of the open port 18, $l_2$ is the length of the open duct port 16, and $V_2$ is the volume of the cavity 17.

In this embodiment, the resonance frequency $f_{OP2}$ is set to coincide with an open duct resonance frequency (fundamental wave) of the open duct port 8, which is given by:

$$f_1=c/2l_1 \quad (3)$$

That is, $$f_{OP2}=c(S_2/l_2V_2)^{\frac{1}{2}}/2\pi$$

$$=c/2l_1=f_1$$

Therefore, $$(S_2/l_2V_2)^{\frac{1}{2}}=/l_1 \quad (4)$$

In the acoustic apparatus of this embodiment, a vibrator 20 consisting of a diaphragm 2 and a converter 3 is attached to the Helmholtz's resonator 10. The converter 3 is connected to a vibrator driver 30. The vibrator driver 30 comprises a servo unit 31 for performing an electrical servo so as to cancel an air reaction from the resonator when the Helmholtz's resonator 10 is driven. As to the servo system, a known circuit, such as a negative impedance generator for equivalently generating a negative impedance component ($-Z_O$) in an output impedance, a motional feedback (MFB) circuit for detecting a motional signal corresponding to the behavior of the diaphragm 2 and negatively feeding back to the input side by a proper means, or the like may be employed.

The operation of the acoustic apparatus shown in FIG. 1 will be described below.

When a drive signal is supplied from the diaphragm driver 30 to the converter 3 of the vibrator 20, the converter 3 electro-mechanically converts the drive signal to reciprocate the vibrator 2 in the back-and-forth direction (right-and-left direction in FIG. 1). The diaphragm 2 mechano-acoustically converts the reciprocal movement. The front surface side (left surface side in FIG. 1) of the diaphragm 2 constitutes a direct radiation portion for directly externally radiating an acoustic wave, and the rear surface side (right surface side in FIG. 1) of the diaphragm 2 constitutes a resonator driving portion for driving the Helmholtz's resonator 10. Although an air reaction from the air in the cavity of the Helmholtz's resonator 10 acts on the rear surface side of the diaphragm 2, the vibrator driver 30 drives the vibrator 20 to cancel the air reaction.

In this manner, since the vibrator 20 is driven to cancel the air reaction from the resonator 10 when the Helmholtz's resonator 10 is driven, the diaphragm 2 of the vibrator 20 cannot be driven from the side of the Helmholtz's resonator, and serves as a rigid body, i.e., a wall. Therefore, the resonance frequency and the Q value of the Helmholtz's resonator 10 are independent from those of the vibrator 20, and the drive energy for the resonator 10 from the converter 3 is given independently of the direct radiation portion. Since the converter 3 is driven in a so-called "dead" state wherein it is not influenced by the air reaction from the resonator 10, the frequency characteristics of a directly radiated acoustic wave are not influenced by the volume of the body portion 6. Therefore, according to the structure of this embodiment, the volume of the cavity 14 in the body portion 6 (e.g., a speaker cabinet) of the Helmholtz's resonator 10 can be reduced as compared to a conventional bass-reflex speaker system. In this case, if the resonance frequency $f_{OP}$ is set to be lower than that of the conventional bass-reflex speaker system, a sufficiently high Q value can be set. As a result, in the acoustic apparatus shown in FIG. 1, if the Helmholtz's resonator 10 is reduced in size as compared to the bass-reflex speaker system, reproduction to lower bass sounds can be performed.

In FIG. 1, the converter 3 drives the diaphragm 2 in response to the drive signal from the vibrator driver 30, and independently supplies drive energy to the Helmholtz's resonator 10. Thus, an acoustic wave is directly radiated from the diaphragm 2 as indicated by an arrow a in FIG. 1. At the same time, air in the Helmholtz's resonator 10 is resonated, and an acoustic wave having a sufficient sound pressure can be resonantly radiated from the resonance radiating portion (open port 9) as indicated by an arrow b in FIG. 1. By adjusting an air equivalent mass in the open duct port 8 in the Helmholtz's resonator 10, the resonance frequency $f_{OP}$ is set to be lower than a reproduction frequency range of the vibrator 20, and by adjusting an equivalent resistance of the open duct port 8 to set the Q value to be an optimal level, a sound pressure of a proper level can be obtained from the open port. Under these conditions, and by appropriately increasing/decreasing an input signal level as needed, the frequency characteristics of a sound pressure shown in FIG. 2 can be obtained.

Upon acoustic wave radiation, in an apparatus without the second Helmholtz's resonator 15, the open duct port 8 suffers from the open duct resonance due to an air flow passing the open duct port 8 of the Helmholtz's resonator 10, and an acoustic wave having a frequency given by above-mentioned equation (2):

$$f_1 = c/2l_1$$

caused by the open duct resonance (indicated by an alternate long and short dashed curve in FIG. 3) is mixed in the resonantly radiated acoustic wave from the Helmholtz's resonator 10 as a distortion or noise component. Such a drawback is also caused when a vibrator (speaker) of a conventional bass-reflex speaker system is driven by a constant voltage by a conventional power amplifier. This is particularly conspicuous when the Q value of the Helmholtz's resonator 10 is improved to increase the sound pressure of the resonance radiation by driving the vibrator 20 to cancel the air reaction from the Helmholtz's resonator 10.

Figure 3:
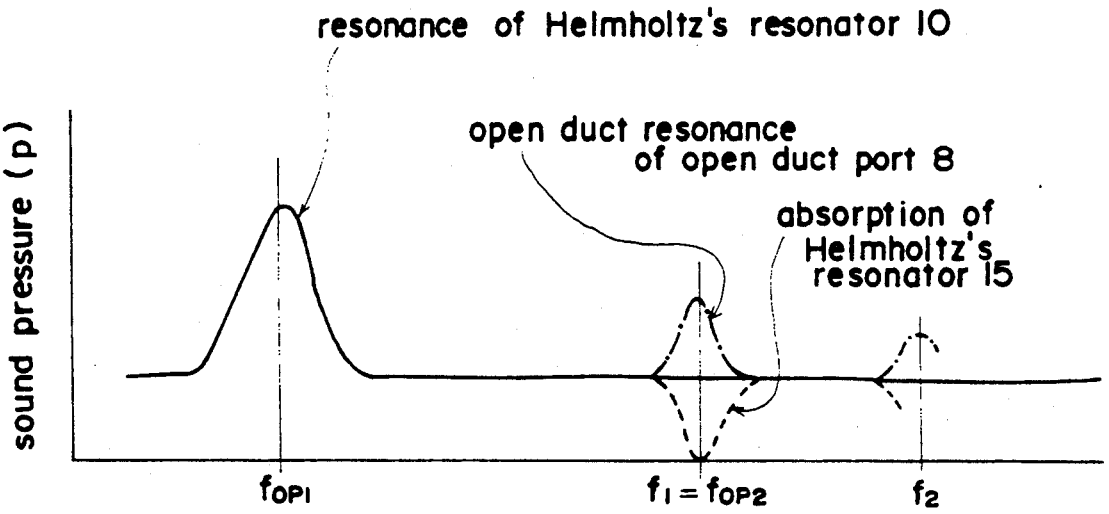
FIG. 3 is a graph showing frequency characteristics of a sound pressure for explaining an unnecessary resonant sound absorption effect in the acoustic apparatus shown in FIG. 1.
Figure 4:
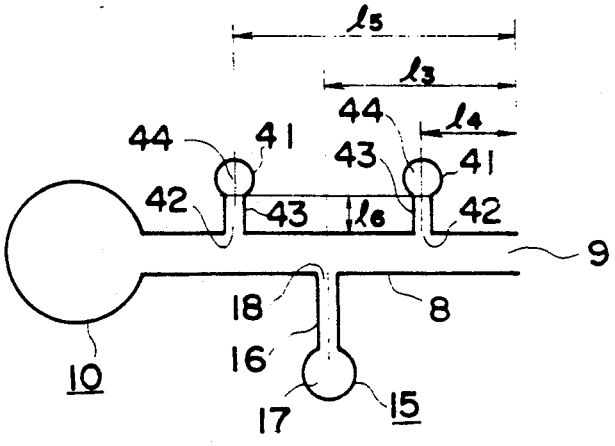
FIGS. 4 to 6 are views showing modifications of the first embodiment.

In the acoustic apparatus shown in FIG. 1, an open duct resonance acoustic wave having a frequency given by $f_1 = c/2l_1$ indicated by an alternate long and short dashed curve in FIG. 3 is absorbed by the second Helmholtz's resonator 15 which is set to have the resonance frequency $f_{OP2} = f_1$, as indicated by a short dashed curve in FIG. 3, and total characteristics from which the open duct resonance acoustic wave is removed can be obtained, as indicated by a solid curve in FIG. 3.

Such an open duct resonance acoustic wave removal effect is maximized when the position of the second Helmholtz's resonator 15, i.e., the opening position of the open port 18 is set at a position where the speed node of the open duct resonance is formed and a pressure is maximized, i.e., a position where a distance $l_3$ from the open port 9 becomes $l_3 = l_1/2$.

Modifications of First Embodiment

Note that the present invention is not limited to the above-mentioned embodiment, and various modifications may be made. For example, open duct resonance occurs at harmonics having a frequency $f_1 = c/2l_1$ as a fundamental wave. When the levels and frequencies of the open duct resonance cannot be neglected, third, fourth,... Helmholtz's resonators which resonate the corresponding harmonics can be arranged at the corresponding speed node positions. For example, in the case of a harmonic of the second order, a third Helmholtz's resonator 41 is arranged at one or both of positions of $l_4 = l_1/4$ and $l_5 = 3l_1/4$, and its dimensional relationship can be determined as $(S_3/l_6V_3)^{\frac{1}{2}} = 2\pi/l_1$. In this $S_3$ is the sectional area of an open port 42, $l_6$ is the length of an open duct port 43, and $V_3$ is the volume of a cavity 44.

Open duct resonance can occur at the open duct port 16 and the like of the second Helmholtz's resonator 15. If the levels and frequencies of the open duct resonance cannot be ignored, the above-mentioned countermeasure can be taken for these open duct port 16 and the like.

Figure 5:
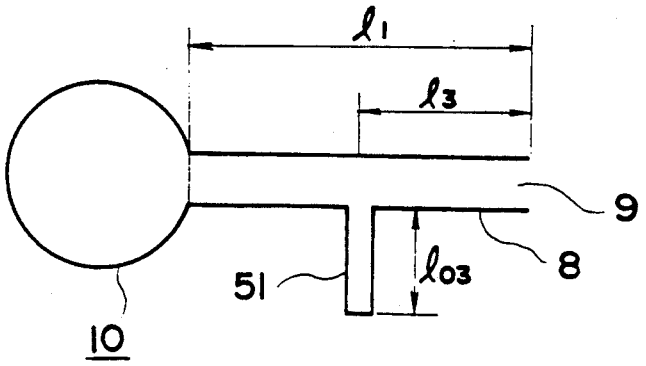

Furthermore, as a resonator for absorbing open duct resonance, a closed duct resonator may be used, as shown in FIG. 5. In this case, a resonance frequency $f_{O3}$ of the closed duct resonator is given by:

$$f_{O3} = c/4l_{03}$$

where $l_{03}$ is the length of a closed duct 51. Therefore, the closed duct 51 having the length $l_{03}$ given by the following equation can be disposed at the open duct port 8:

$$l_{03} = l_1/2$$

The closed duct resonator can maximize the unnecessary resonance absorption effect when it is arranged at a position where a distance from the open port 9 is given by $l_3 = l_1/2$.

Figure 6:
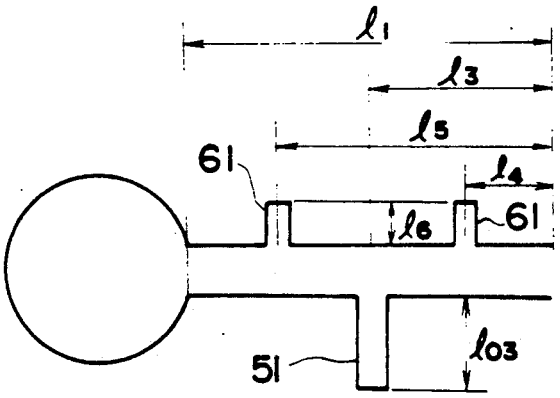

This closed duct resonator may be used in order to absorb harmonics of the second, third,. . . orders caused by the open duct resonance. For example, in the case of a harmonic of the second order, third,. . . closed duct Helmholtz's resonators 61,. . . may be arranged as shown in FIG. 6. In this case, the third Helmholtz's resonator 61 is arranged of one or both of positions of $l_4 = l_1/4$ and $l_5 = 3l_1/4$ to have a length $l_6 = l_1/4$.

The closed duct resonators utilize closed duct resonance of a fundamental wave for open duct resonance absorption of the open duct port. A closed duct resonant sound of the harmonics of these closed duct resonators may pose a new problem. In order to absorb this, the above-mentioned countermeasure can be taken for these closed duct resonators. In this case, it should be noted that the position of the speed node of closed duct resonance of the harmonics is slightly different from that of open duct resonance described above. The speed node of the harmonic of the second order of the closed duct resonance appears at a duct closed end and a position returning backward from this end to the open end side by ⅓ the duct length.

Note that both the above-mentioned Helmholtz's resonators and closed duct resonators may be used at the same time as sound absorption resonators. A sound absorption member may be filled in these resonators to improve a sound absorption effect.

Second Embodiment

A second embodiment of the present invention will be described below with reference to FIGS. 7 to 14.

Figure 7:
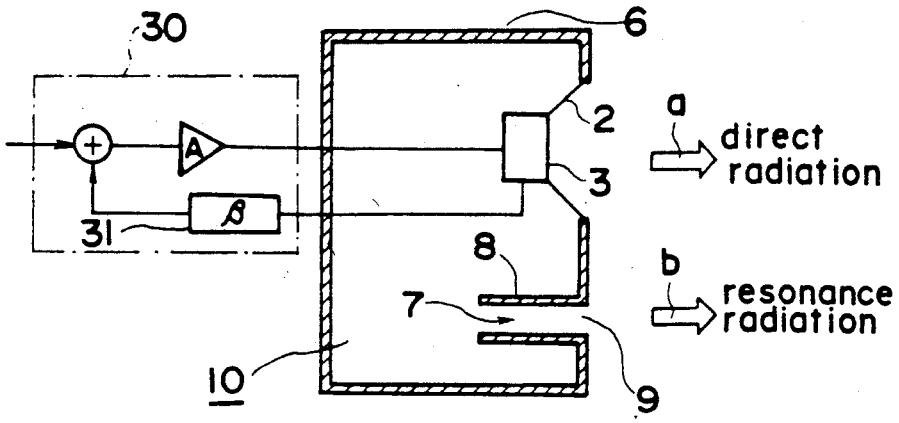
FIG. 7 is a view for explaining the basic structure of a second embodiment of the present invention.

FIG. 7 shows the basic structure of an acoustic apparatus according to the second embodiment of the present invention. In the acoustic apparatus of FIG. 7, a hole is formed in the front surface of an enclosure 6, and a vibrator consisting of a diaphragm 2 and a dynamic electro-acoustic converter (speaker) 3 is mounted in the hole. An open duct port 8 having a sound path 7 open to the outside of the enclosure 6 is formed below the vibrator, and the open duct port 8 and the enclosure 6 form a Helmholtz's resonator. In this Helmholtz's resonator, an air resonance phenomenon is caused by an air spring in the enclosure 6 as a closed cavity and an air mass in the sound path 7 of the open duct port 8. A resonance frequency $f_{OP}$ is given as in equation (1) by:

$$f_{OP}=c(S/lV)^{\frac{1}{2}}/2\pi \quad \ldots (5)$$

where c is the sonic speed, S is the sectional area of the sound path 7, l is the length of the open duct port 8, and V is the volume of the enclosure 6. The converter 3 is connected to a vibrator driver 30. In the second embodiment, the vibrator driver 30 is the same as that in the first embodiment. The Helmholtz's resonators 10 in the first and second embodiments have different outer appearances, i.e., a spherical shape and a rectangular prism shape, and the direction of the vibrator 20 and the positional relationship of the open duct port 8 are also different from those in the first embodiment. However, the first and second embodiments have substantially the same basic structure. Therefore, the vibrator driver 30 and the Helmholtz's resonator 10 operate in the same manner as in the first embodiment.

Figure 8:
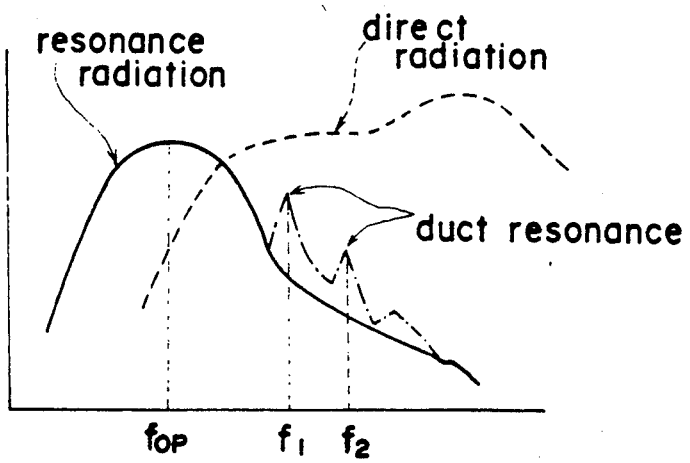
FIG. 8 is a graph showing frequency characteristics of a sound pressure of an acoustic wave radiated from an acoustic apparatus shown in FIG. 7.
Figure 9:
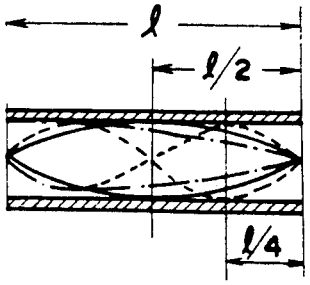
FIG. 9 is a view for explaining a state of open duct resonance at an open duct port shown in FIG. 7.

In the acoustic apparatus, when the open duct port 8 is formed of a rigid body such as plastic or wood like in the conventional apparatus, as has been described in the first embodiment, the open duct port 8 suffers from open duct resonance due to an air flow passing the open duct port 8 by the Helmholtz's resonance, and acoustic waves having frequencies:

$$f_1=c/2l_1 \quad (6)$$

$$f_2=c/4l_1 \quad (7)$$

similar to that given by equation (3) described above by the open duct resonance are radiated as indicated by an alternate long and short dashed curve in FIG. 8. These waves are mixed in a resonantly radiated acoustic wave of the Helmholtz's resonator as a distortion or noise component. This drawback is conspicuous when the Q value of the Helmholtz's resonator 10 is improved to increase the sound pressure of the resonance radiation by driving the converter 3 to cancel the air reaction from the Helmholtz's resonator.

In the embodiment shown in FIG. 7, the entire open duct port 8 is constituted by felt. For this reason, an air density upon resonance repetitively becomes coarse and dense at the speed node of open duct resonance shown in FIG. 9, i.e., the antinode of a pressure wave. However, the air density cannot sufficiently become coarse and dense due to air permeability of felt, and resonance does not easily occur. Since the inner surface of the felt open duct port has a large resistance against movement of air, resonance energy is absorbed and is converted to heat, thus reducing a resonance level. Furthermore, the inner surface of the open duct port does not serve as a solid wall due to flexibility of felt, and serves as a passive damper to absorb an acoustic wave due to duct resonance of the open duct port.

As a result, open duct resonance frequencies appearing as peak values at the position of frequencies $f_1$ and $f_2$ in FIG. 8, i.e., a noise or distortion component caused by open duct resonance can be reduced or extinguished.

In place of felt, other materials having an acoustic resistance, such as sponge, unwoven fabric, fabric, and the like may be used. In the following description, felt, sponge, unwoven fabric, fabric and the like are called felt and the like.

Modifications of Second Embodiment

FIGS. 10 to 14 respectively show modifications of the open duct port shown in FIG. 7.

Figure 10:
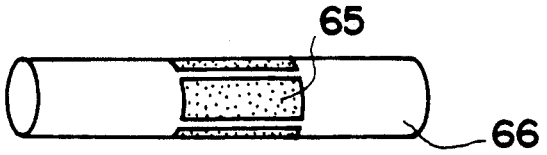
FIGS. 10 to 14 are views showing modifications of an open duct port shown in FIG. 1.

In an open duct portion shown in FIG. 10, a portion corresponding to the speed node of a fundamental wave of open duct resonance, i.e., the central portion of the open duct port is formed by felt and the like 65, and the remaining portion 66 is formed by a rigid material like in the conventional port.

Figure 11A:
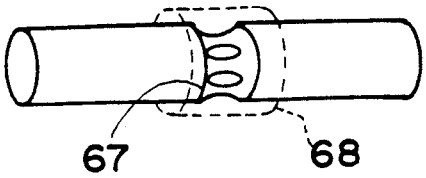
Figure 11B:
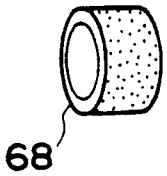

In an open port shown in FIG. 11, the central portion is carved from the outside, and openings 67 are formed in the central portion. The openings 67 are covered with a cylinder formed of felt and the like 68. Note that when unwoven fabric or fabric is used as the felt and the like, these materials need not be formed into a cylindrical shape but are formed into a belt-like shape, and are wound in a corresponding amount on the opening 67 portions.

Figure 12:
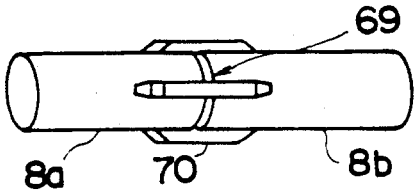

In an open duct port shown in FIG. 12, two open duct ports **8*a* and 8*b* having the same length are coupled through a coupling/supporting member 70 with a small gap 69**.

Figure 13:
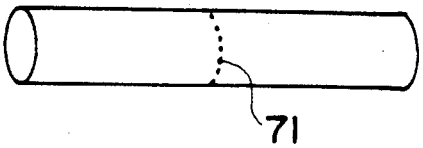

In an open duct port shown in FIG. 13, microholes 71 are formed in the central portion.

Figure 14:
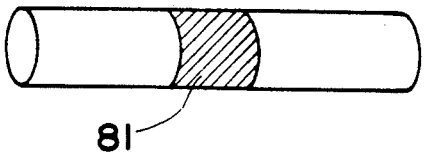
Figure 15A:
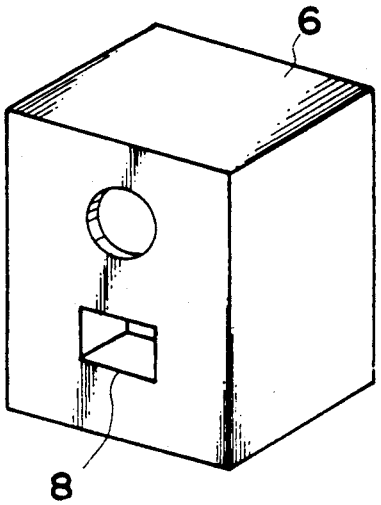
FIG. 15A PRIOR ART
FIGS. 15A and 15B are respectively a perspective view and a sectional view showing a structure of a conventional bass-reflex speaker system.
Figure 15B:
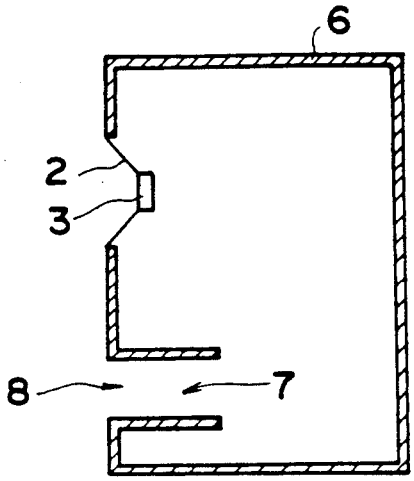
FIG. 15B PRIOR ART
Figure 16:
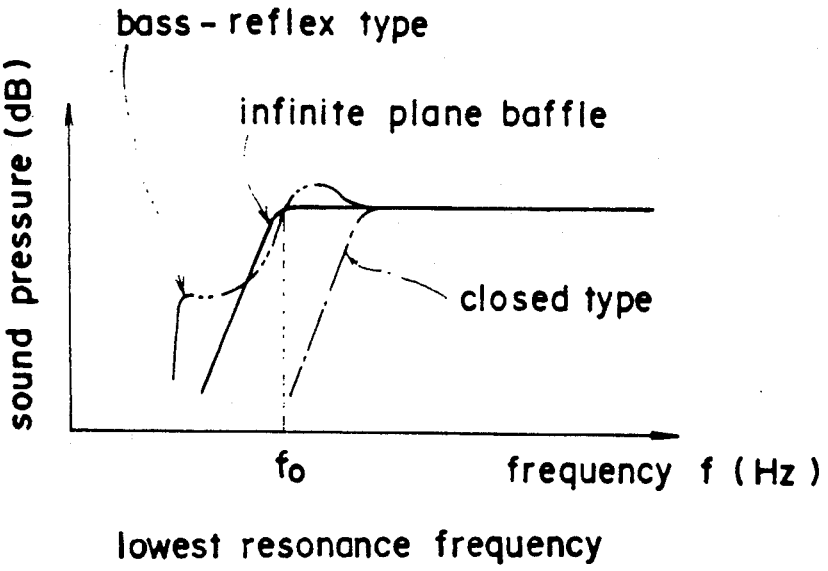
FIG. 16 PRIOR ART
FIG. 16 is a graph for explaining sound pressure characteristics of the speaker system shown in FIGS. 15A and 15B.

In an open duct port shown in FIG. 14, the central portion 81 is formed of a material having flexibility and viscoelasticity, e.g., rubber. Such a material exhibits a pressure relaxing effect substantially equivalent to air permeability of the felt and the like. In addition, the material serves as a resistance for consuming energy when it is flexed.

What is claimed is:

1. An acoustic apparatus comprising:

a cabinet with an open duct attached thereto for radiating acoustic waves by resonance, the cabinet having an internal cavity which together with said duct defines a Helmholtz resonator;

a vibrator having a diaphragm for driving said Helmholtz resonator;

a vibrator driver supplying a drive signal to the vibrator, wherein said vibrator driver includes a servo unit to control the vibrator to substantially cancel reaction from the Helmholtz resonator; and duct resonance absorbing means, situated at or near an antinode position of resonance of the open duct, for reducing resonance from the open duct.

2. An acoustic apparatus according to claim 1, wherein said duct resonance absorbing means comprises sound absorbent material incorporated into a wall of the open duct.

3. An acoustic apparatus according to claim 1, wherein said duct resonance absorbing means comprises one or more openings in the open duct to relieve pressure therein.

4. An acoustic apparatus according to claim 1, wherein said duct resonance absorbing means has an internal cavity therein and a duct which together define a second Helmholtz resonator with the duct of the second Helmholtz resonator opening into the open duct of the Helmholtz resonator of the cabinet.

5. An acoustic apparatus comprising:

a cabinet with an open duct attached thereto for radiating acoustic waves by resonance, the cabinet having an internal cavity which together with said open duct defines a first Helmholtz resonator;

a vibrator having a diaphragm for driving said Helmholtz resonator;

a vibrator driver supplying a drive signal to the vibrator; and duct resonance absorbing means for reducing open duct resonance from the open duct, wherein said duct resonance absorbing means has an internal cavity therein and a duct which together define a second Helmholtz resonator having the duct thereof opening into the open duct of the first Helmholtz resonator and having a resonant frequency substantially equal to a resonant frequency of the open duct of the first Helmholtz resonator.

6. An acoustic apparatus according to claim 5, wherein the second Helmholtz resonator comprises a second cabinet and the duct thereof has one end opening into the second cabinet and another end opening to the open duct of the first Helmholtz resonator.

7. An acoustic apparatus according to claim 5 wherein the duct of the second Helmholtz resonator has one end closed and another end opening to the open duct of the first Helmholtz resonator.

8. An acoustic apparatus according to claim 5 wherein the second Helmholtz resonator is located at an antinode position of open duct resonance of the open duct of the first Helmholtz resonator.

* * * * *